US007841794B2

(12) United States Patent
Salciarini et al.

(10) Patent No.: US 7,841,794 B2
(45) Date of Patent: Nov. 30, 2010

(54) CONTAINER FOR LIQUID, SOLID, PASTE OR POWDER COSMETIC PRODUCT WITH RETRACTABLE APPLICATOR ELEMENT

(75) Inventors: Christian Salciarini, Couilly Pont Aux Dames (FR); Sylvie Legastelois, Asnieres sur Seine (FR); Olivier Perrin, Chatillon (FR)

(73) Assignee: Chanel Parfums Beaute, Neuilly-sur-Seine (FR)

( * ) Notice: Subject to any disclaimer, the term of this patent is extended or adjusted under 35 U.S.C. 154(b) by 1087 days.

(21) Appl. No.: 11/430,177

(22) Filed: May 9, 2006

(65) Prior Publication Data

US 2007/0110502 A1 May 17, 2007

(30) Foreign Application Priority Data

May 10, 2005 (FR) ..... 05 04684

(51) Int. Cl.
*A45D 40/00* (2006.01)

(52) U.S. Cl. ..... 401/98; 401/262

(58) Field of Classification Search ..... 401/98, 401/131, 102, 110–112, 202, 262; 206/385
See application file for complete search history.

(56) References Cited

U.S. PATENT DOCUMENTS 7,429,140 B2 * 9/2008 Demellier ..... 401/98
2004/0119297 A1 6/2004 Bella et al.

FOREIGN PATENT DOCUMENTS

| | | |
|---|---|---|
| DE | 3426351 A1 | 1/1986 |
| FR | 2865910 | 8/1985 |
| FR | 2870092 A | 11/2005 |
| GB | 834486 | 5/1960 |

OTHER PUBLICATIONS

International Search Report; International Application No. PCT/FR2006/001030, dated Sep. 13, 2006, 3 pages.
European Search Report; Application No. EP1721543A1, dated Aug. 31, 2006.

* cited by examiner

*Primary Examiner*—David J Walczak
(74) *Attorney, Agent, or Firm*—Hunton & Williams LLP

(57) ABSTRACT

A container for a solid, liquid, paste or powder cosmetic product, comprising a product applicator element having a transverse face and a tubular storage element elongate in a longitudinal direction and having a bottom and an annular end, the applicator element being mounted in the tubular storage element, is characterized in that the applicator element is a friction fit in the tubular storage element and bears against a mobile part slidably mounted in the tubular element and connected thereto by an elastically compressible device with two axial retraction configurations relative to an axial depression configuration, the two axial retraction configurations respectively defining a first configuration of the applicator element in which its transverse face is flush with the annular end of the tubular element and a second configuration in which its transverse face projects relative to that annular end of the tubular element to a given distance that is significantly greater than the axial depression travel of the elastically compressible device between the first axial retraction configuration and the axial depression configuration.

24 Claims, 11 Drawing Sheets

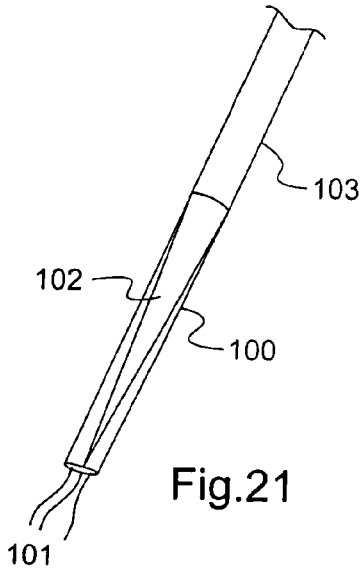
Fig.21
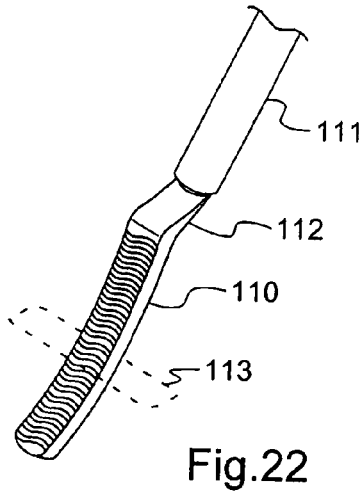
Fig.22
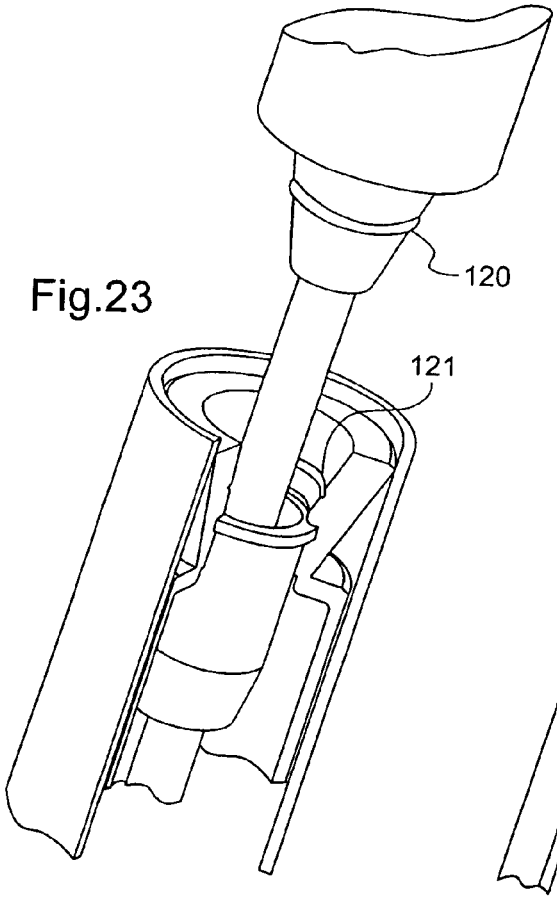
Fig.23
Fig.24
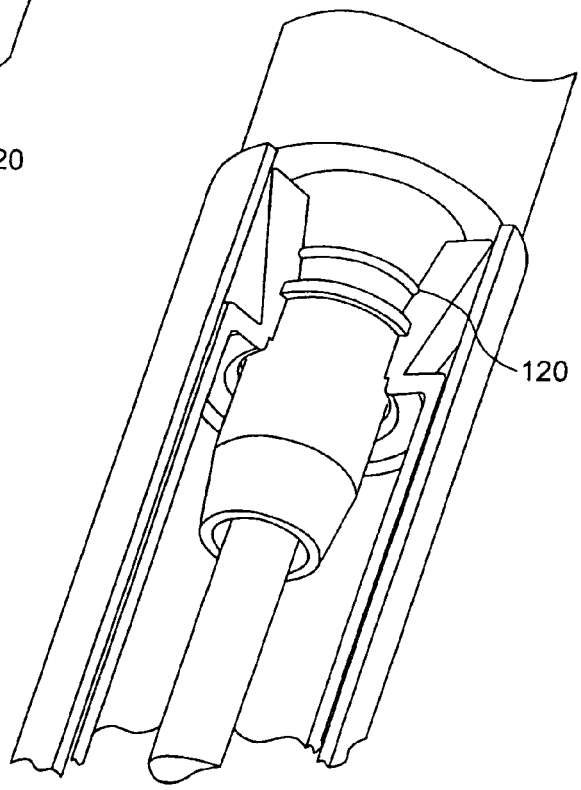

CONTAINER FOR LIQUID, SOLID, PASTE OR POWDER COSMETIC PRODUCT WITH RETRACTABLE APPLICATOR ELEMENT

CROSS-REFERENCE TO RELATED APPLICATIONS

This application claims priority to French Application FR 0504684, filed May 10, 2005, which is incorporated herein by reference.

BACKGROUND OF THE INVENTION

The invention relates to a container for a liquid, solid, paste or powder cosmetic product including an applicator member that is inserted in a tubular storage element when the product is not being applied; it relates in particular, although not exclusively, to containers for lipstick, mascara, lip-gloss, foundation, eye shadow or blusher, and even nail varnish. Lipstick containers conventionally comprise an applicator element including a support carrying a stick of lipstick, a tubular body (of circular or other section) in which the support may be moved axially, at will, to deploy the lipstick or to retract it into the tubular body, and a tubular storage element forming a cap cooperating with the tubular body to enclose and protect the stick when the user does not need to use it.

Diverse structures have been proposed for lipstick containers of the above kind, differing according to whether movement of the support is driven directly or indirectly.

The family of lipstick containers with directly driven supports includes those that include a spring compressed between the bottom of the tubular body and the bottom of the support so that the support is spring-loaded continuously toward the exterior of the tubular body, which makes it obligatory to control the effect of the spring. In this regard there may be cited the document U.S. Pat. No. 2,486,960 which describes a support retained by friction in an elliptical body the clamping force whereof is reduced on each closure of the cap, which allows the spring to move the support forward toward the outlet of the tubular body. There may also be cited the document FR-A-1 011 995 in which movement in translation of the support is driven by direct action on a lateral projection of that support passing through a slot formed in the wall of the tubular body and on which the cap acts in the direction of retraction into the interior of the tubular body when the cap is screwed on.

Direct drive through action on a lateral projection may instead be obtained without the intervention of a spring, as disclosed in particular in the document U.S. Pat. No. 3,954,114 (in which a lid must be opened synchronously with movement in translation of the lipstick) or the document U.S. Pat. No. 4,182,945.

Instead of a lateral projection attached to the support, the document U.S. Pat. No. 3,989,392 proposes a fixed axis thumbwheel accessible from the outside through an opening in the wall of the body and cooperating with a rack attached to the support.

These solutions using a thumbwheel or a lateral projection that is moved longitudinally have the particular drawback that they do not offer any protection against unintentional operation, for example if the projection or the thumbwheel catches on an adjacent object in a bag or pocket.

Another principle of direct drive of movement of the lipstick is described in the document U.S. Pat. No. 4,621,935, where deployment of the stick is driven by pressing directly on the bottom of the support of the stick, through a hole formed in the bottom of the tubular body, which requires that the latter be of large section, to avoid the user having to employ a tool when most of the lipstick has been used up. Note that nothing is provided for retracting the stick into the tubular body, with the result that the stick projects therefrom at all times; what is more, the opening in the bottom of the tubular body has the two-fold drawback of being somewhat unaesthetic and of constituting a trap for dust and other detritus.

In the situation, that is currently more frequent, of indirectly driven movement of the lipstick, the tubular body, sometimes called the cartridge, comprises a wall and a mobile base rotation whereof relative to the wall drives axial movement in translation of the support and the lipstick inside the wall, thanks to appropriate guide ribs. To facilitate manipulation by the user, the base is in practice made larger than the wall and it is against the annular edge connecting the base to the wall that the free edge of the cap abuts when the latter is in the closed position, capping the tubular body.

In this regard see in particular the documents GB-834 486 and U.S. Pat. No. 3,515,493 and the more recent document EP-A-1 293 146.

Generally speaking, in indirect drive containers the enlarged base of the tubular body remains outside the cap so as to remain accessible to the user, and the risk therefore remains of unintended separation of the cap and the base. To avoid this risk, and to ensure effective closure of the cap onto the tubular body, it is standard practice to lock the cap either by screwing it on or by clipping it on, but opening the container then requires the user to execute a combination of movements. In the case of the document GB-834 486 cited above, a cap is used that is completely closed by a cover and fitting the cover prevents the tubular body from being deployed by a compression spring; the tubular body is completely concealed by the cap and its cover, which protects it from all external action, although the risk of unintended operation remains since the cover can be opened by mistake.

One way of defining how mascara containers differ from lipstick containers is to say that, although in the case of lipstick containers the solid product to be applied is contained in the applicator element, in the case of mascara containers the product to be applied is a liquid and is contained in the tubular element into which the applicator element penetrates when not in use. To be more precise, the tubular element conventionally includes a wiper that retains excess product picked up by the applicator when it is dipped into the liquid product.

In mascara containers the applicator element in practice includes a cap on which the user acts to manipulate the mascara applicator end. Moreover, the fact that mascara is liquid means that an effective seal must be provided when mascara is not being applied and the cap is engaged over the neck of the container; in practice this seal is obtained by screwing or clipping the cap onto the neck of the container. It follows that the cap forms a substantial portion of the exterior surface of a mascara container when in the closed configuration and that combined movements or significant forces are needed to open the container before applying the mascara.

Other mascara container configurations are known, for example from the documents GB-A-2 132 883 and U.S. Pat. No. 6,371,129, in which the applicator is mounted so that it can be retracted into the tubular element, in which it is immersed completely in the product, and subject to the action of a spring for deploying the applicator end out of the tubular element. In particular this arrangement has the drawbacks mentioned above in respect of lipstick containers operated by a spring.

Similar drawbacks are identified on analyzing other cosmetic product containers known in the art, such as containers for lip-gloss, foundation, eye shadow or blusher, and even nail varnish.

SUMMARY OF THE INVENTION

The subject matter of the invention is a simple and reliable container for a solid, liquid, paste or powder cosmetic product, including an applicator element and a tubular storage element adapted to receive that applicator element, which container represents no significant risk of unintentional opening, provides for highly refined esthetics and does not result in an unacceptable overall size.

To this end the invention proposes a container for a solid, liquid, paste or powder cosmetic product, comprising a product applicator element having a transverse face and a tubular storage element elongate in a longitudinal direction and having a bottom and an annular end, the applicator element being mounted in the tubular storage element, which container is characterized in that the applicator element is a friction fit in the tubular storage element and bears against a mobile part slidably mounted in the tubular element and connected thereto by an elastically compressible device with two axial retraction configurations relative to an axial depression configuration, the two axial retraction configurations respectively defining a first configuration of the applicator element in which its transverse face is flush with the annular end of the tubular element and a second configuration in which its transverse face projects relative to that annular end of the tubular element to a given distance that is significantly greater than the axial depression travel of the elastically compressible device between the first axial retraction configuration and the axial depression configuration.

Clearly the fact that the applicator element can be retracted completely into the tubular storage element prevents any unintentional extraction of that element by it catching on any adjacent object in a handbag or pocket. The risk of accidental depression of the applicator element into the tubular element is very low in practice; moreover, if any such unintentional depression were to occur, the fact that the applicator element projects (because the elastically compressible device assumes its maximum retracted configuration) is in no way sufficient to generate any significant risk of unintentional extraction by an adjacent object. Effective protection against the risk of extraction of the applicator element from the tubular storage element is therefore obtained. However, this extraction is easy to obtain when the user requires it since a slight push on the edge is sufficient to move the applicator element into its projection configuration from which it is easy to extract by gripping the base of the applicator element; there is no movement necessitating a significant force, as with a clip closure, and no rotation.

Moreover, to the extent that the applicator element is completely retracted into the tubular storage element, the appearance of the container is determined only by the tubular element (only the free transverse face of the tubular element is visible, in particular provided that the container is not placed on a table or other support) and it is in particular possible for it to have a very refined appearance, with no break line along its lateral wall, which results in great freedom for deciding on the esthetics of the container, which can prove to be a highly significant sales factor in the field of cosmetics.

Nevertheless, the above kind of retraction might seem a priori to be incompatible with the need to be able to extract the applicator element easily when required, by simple movements. Moreover, it might appear paradoxical to begin the extraction of an applicator element of this kind by a depression movement. In fact elastically compressible devices with two axial retracted configurations are already known in the art, in fields far removed from that of cosmetics and quite apart from any concept of flush mounting, in particular in the field of retractable ball-point pens, although in this case a mechanical retainer usually prevents the button at the top of such ball-point pens from escaping, which could dissuade the person skilled in the art from considering such mechanisms; furthermore, assuming that the person skilled in the art had shown an interest in such mechanisms, he would be very likely be consider that, in the absence of any such mechanical retention, this kind of device would not have a reliability compatible with the reliability, solidity and stability requirements are encountered in the field of cosmetics. Moreover, the usual concern to make maximum use of the available volume would dissuade the person skilled in the art from considering the above kind of device, which implies reducing the usable proportion of the volume of the container to accommodate this kind of elastically compressible device; it has nevertheless become apparent that this kind of device can be used under or around the mobile part within a volume that is reasonable compared to the overall size of a cosmetic product container, and that the loss of usable volume to accommodate this kind of device is entirely acceptable given the advantages obtained in compensation therefore, from the points of view of safety, discretion and reliability (see above, in particular).

According to preferred features of the invention, which may be combined where appropriate:

- a the friction fit of the applicator element is obtained in a female portion forming part of the mobile part,
- the applicator element includes an annular bearing surface adapted to cooperate with a complementary bearing surface of the mobile part, which determines well the position of the applicator element in the tubular storage element in the out of service configuration, as a function of the position of that mobile part,
- a the applicator element has an annular end adapted to bear against a bottom portion of the mobile part,
- a the friction fit of the applicator element is alternatively obtained in a female portion fastened to the tubular storage member,
- a the elastically compressible device comprises a spring disposed axially between a first bearing surface attached to a heart-shaped closed guide track globally situated in a plane parallel to the axis of the tubular element and a second bearing surface attached to a transverse follower finger adapted to follow the guide track on relative movement between the bearing surfaces,
- the first bearing surface attached to the guide track is attached to the tubular storage element and the second bearing surface attached to the follower finger is attached to the mobile part,
- the first bearing surface attached to the guide track is attached to the mobile part and the second bearing surface attached to the follower finger is attached to the tubular storage element,
- a the guide track and the finger are disposed axially between the mobile part and the bottom of the tubular storage element,
- a the first bearing surface is attached to two guide tracks that are symmetrical to each other with respect to an axial plane and the second bearing surface is attached to two follower fingers that are symmetrical to each other with respect to said axial plane,
- the elastically compressible device includes a spring disposed axially between a fixed bearing surface attached to the tubular storage element and a ring that is mobile in rotation and in translation, bears on the bottom of the mobile part and has radial projections pressed against a sawtooth-shaped annular track with troughs of at least two different heights, the product is a stick of lipstick, the product is a liquid or a paste and is contained in the mobile part, the applicator element including a stem terminating in an applicator adapted to be charged with product and the mobile part including a neck adapted to have the stem pass through it, the stem and the neck including complementary sealing means, the complementary sealing means include a protuberance on the stem and claws on the neck adapted to be separated from the axis when the mobile part is in the maximum retracted position and to be moved towards the axis when the protuberance pushes the claws and therefore the mobile part towards the bottom of the tubular element, the claws are conformed to apply an axial force to the protuberance when they are moved towards the axis so as to press the protuberance against a seat formed in the neck, the liquid product is nail varnish, the neck is provided with a wiper adapted to wipe the applicator as it leaves the mobile part, the applicator and the wiper have non-circular cross sections, said liquid or paste product is mascara, said product is lip-gloss, a said product is foundation, a said product is blusher or eye shadow.

In one embodiment, the invention comprises a container for a solid, liquid, paste or powder cosmetic product, comprising:

a product applicator element having a transverse face, and a tubular storage element elongate in a longitudinal direction and having a bottom and an annular end;

wherein the applicator element bears against a mobile part that is slidably mounted in the tubular element, the mobile part connected to the tubular element by an elastically compressible device with two axial retraction configurations relative to an axial depression configuration;

the two axial retraction configurations respectively defining:

a first axial retraction configuration of the applicator element wherein its transverse face is flush with the annular end of the tubular element, and a second axial retraction configuration in which its transverse face projects relative to the annular end of the tubular element to a distance that is significantly greater than an axial depression travel of the elastically compressible device between the first axial retraction configuration and the axial depression configuration.

BRIEF DESCRIPTION OF THE FIGURES

Objects, features and advantages of the invention emerge from the following description, given by way of nonlimiting illustration with reference to the appended drawings, in which:

FIG. 21 is a partial perspective view of another applicator, FIG. 22 is a partial perspective view of a further applicator that does not exhibit axial symmetry, FIG. 23 is a partial perspective view of one embodiment of the sealing elements between a stem of an applicator and a mobile part forming a reservoir, shown in an open configuration, and FIG. 24 is another partial perspective view of the sealing elements, shown in a closed configuration.

DETAILED DESCRIPTION OF THE INVENTION

Figure 1:
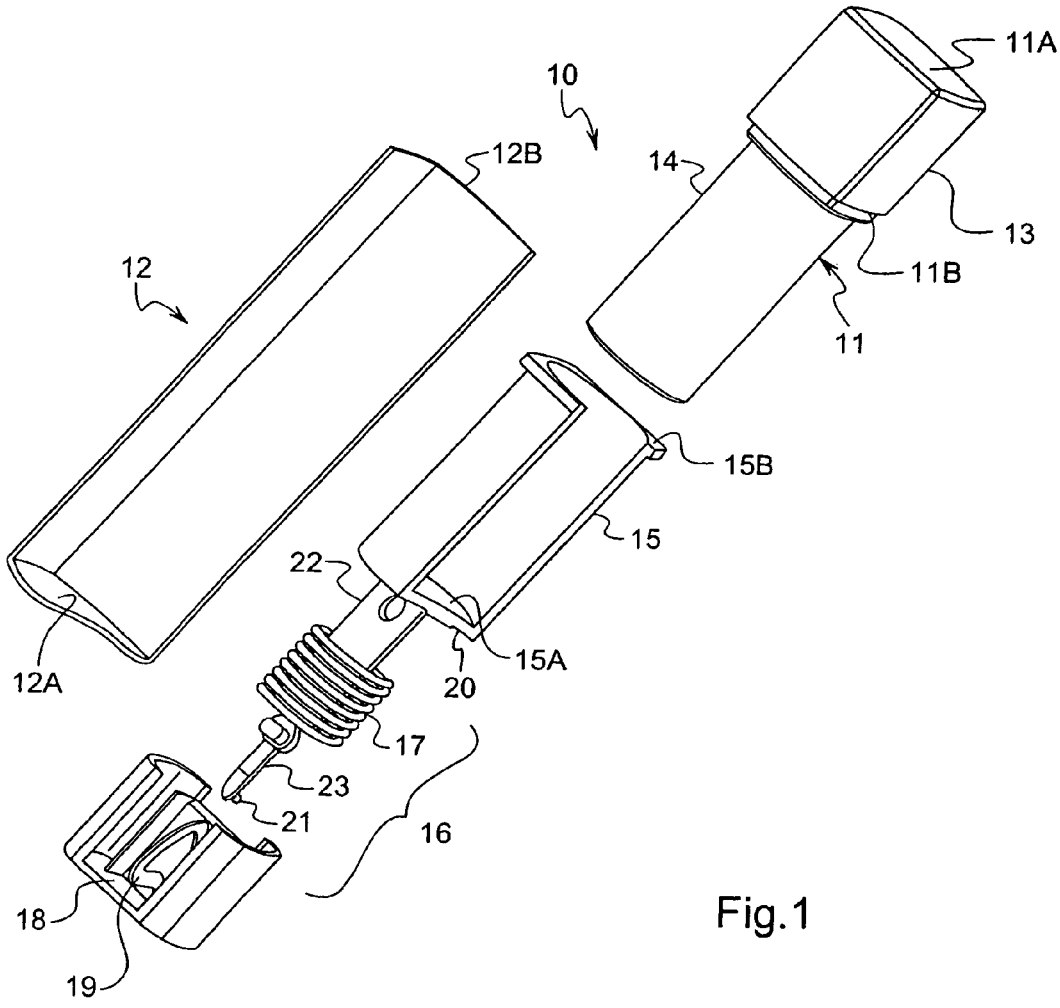
FIG. 1 is a partly cut-away exploded perspective view of a lipstick container of the invention.
Figure 2:
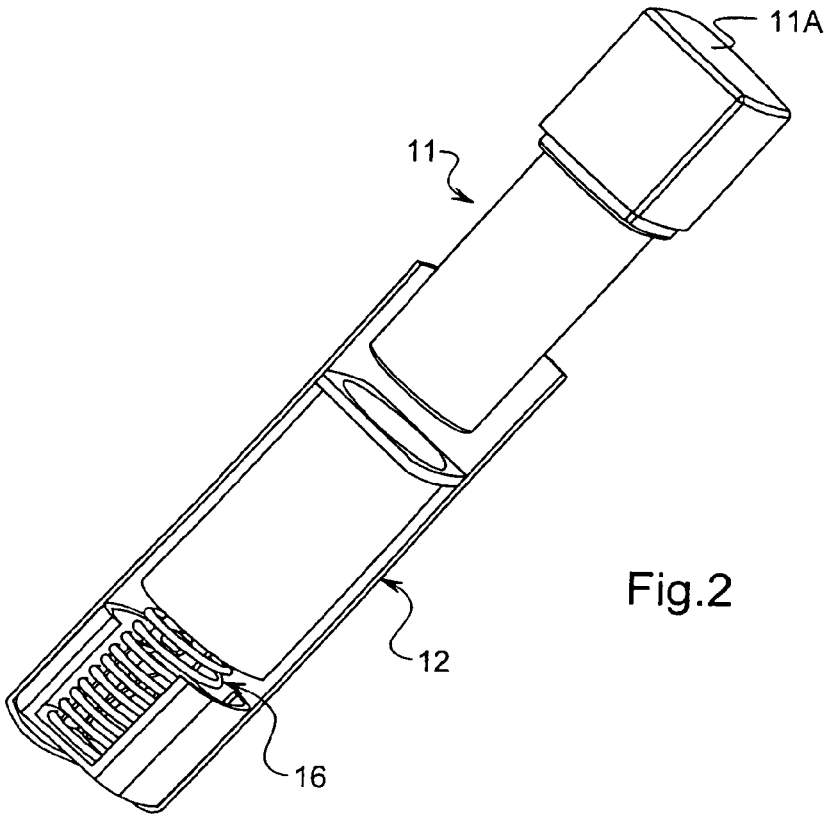
FIG. 2 is a perspective view of the same container, showing the exterior wall of the tubular storage element partly cut away and the applicator element moved only a very small distance away from the sheath.
Figure 3:
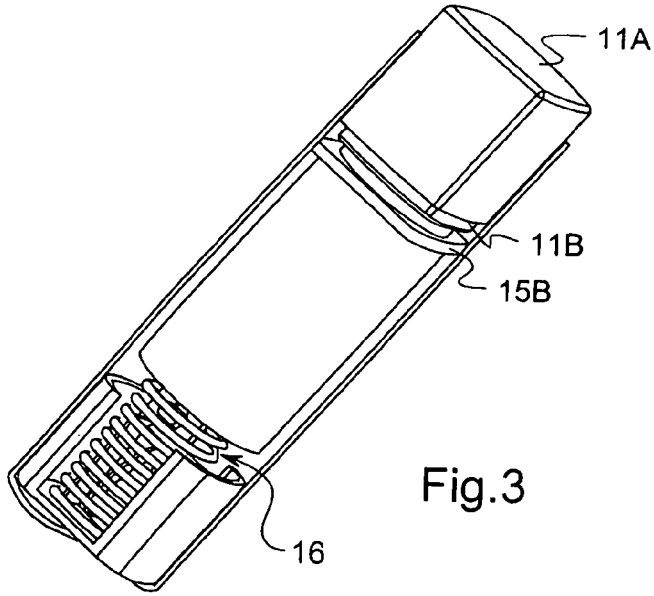
FIG. 3 is another perspective view of the container, showing the partially projecting applicator element abutted against the free edge of the sheath.

FIGS. 1 to 9 show a lipstick container 10 of the invention that includes an applicator element 11 and a tubular storage element 12 that is elongate in a longitudinal direction and is adapted to receive the applicator element.

The applicator element has a rear transverse face 11A the section whereof is the maximum section of the element 11 and the tubular element 12 has a bottom 12A and an annular end 12B.

To be more precise, in a manner that is known in the art, the applicator element here includes a rotatable base 13 and a tube 14 containing a stick of lipstick mounted on a support (not shown) adapted to slide in order to deploy or to retract the lipstick, as a function of the angular position of the base; it is the rear face of the base that constitutes the transverse face cited above. The tube with its support and the lipstick engaged therein are usually referred to as a lipstick cartridge.

A sheath 15 is mounted so that it can slide in the tubular storage element and the applicator element 11 is adapted to be a friction fit inside the sheath, which advantageously has a bottom 15A to protect the bottom of the tubular element from what is inside the sheath.

The applicator element, here the base, preferably has an annular bearing surface 11B adapted to align with a free edge 15B of the sheath.

The applicator element advantageously bears against the bottom of the sheath at its front end.

The tubular element 12 constitutes a protective cap for the sheath and defines the covering of the container.

An elastically compressible device 16 between the sheath and the bottom of the tubular element has two axial retracted configurations.

It includes a spring 17 disposed axially between a first bearing surface 18 attached to a heart-shaped closed guide track 19 situated in a plane parallel to the axis of the tubular element and a second bearing surface 20 connected to a transverse follower finger 21 adapted to follow the guide track on relative movement between the bearing surfaces.

In the present example, the first bearing surface is attached to the bottom of the tubular element and the second bearing surface is attached to the bottom of the sheath.

Here the guide track 19 is a groove forming a closed loop and a plate 22 extends along the finger to prevent it escaping from the groove.

The finger is mounted at the end of a rod 23 having a degree of freedom in bending parallel to the plane containing the track, thus enabling the finger to follow the sinuous track.

Figure 4:
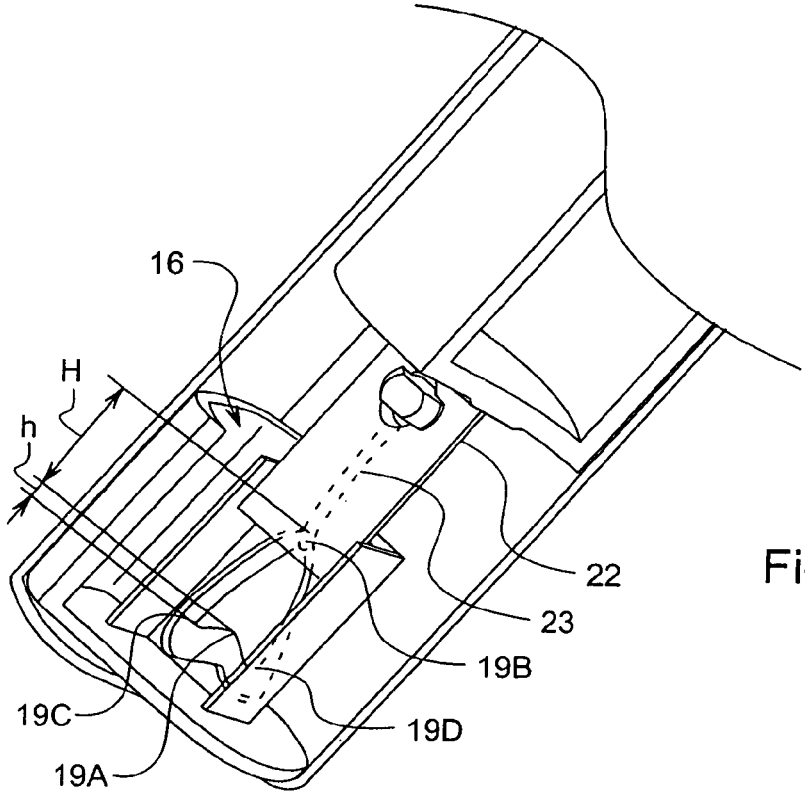
FIG. 4 is a partial perspective view showing the elastically compressible device in a maximum retraction position, without the spring.

The heart shape of the guide track is inverted, so as to have angular portions 19A and 19B that point toward the exterior of the tubular element (see FIG. 4). The axial distance H between these angular portions determines the axial distance between the retracted positions of the device.

To go from one angular portion to the other, the finger must get past one of the convex portions 19C and 19D, and it is clear that because of this the axial level of the convex portions defines the depth to which the finger must be depressed to go from one retracted position to the other.

Note that the depression travel h necessary to go from the minimum retracted position (that corresponding to the trough of the heart shape) to the other position is very much less than the axial distance between the retracted positions.

Figure 5:
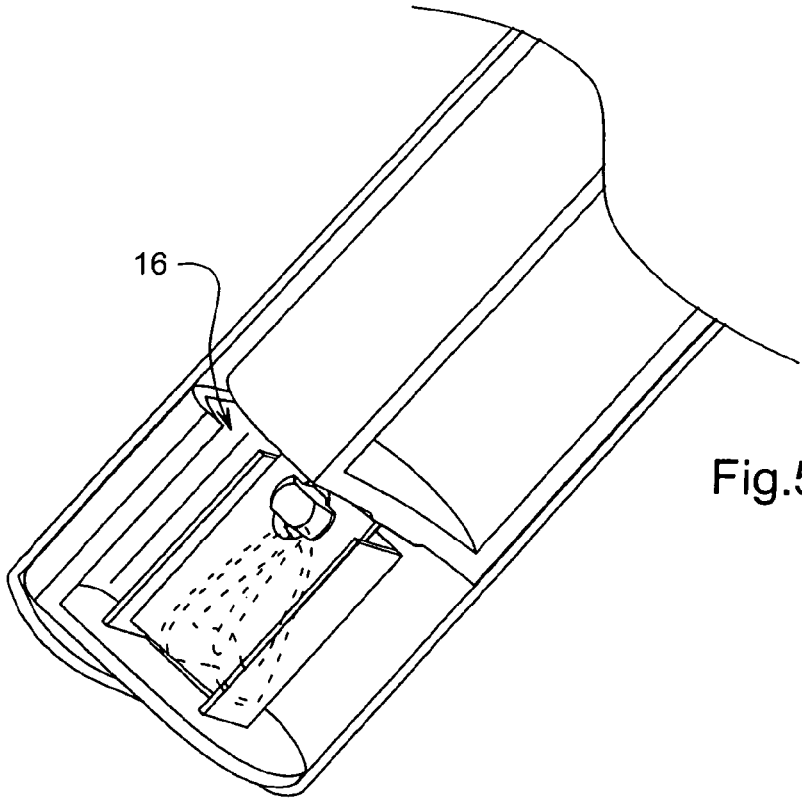
FIG. 5 is a partial perspective view showing the device in a minimum retraction position, again without the spring.

The cooperation between the applicator element and the sheath is such that, when the finger is in its minimum retracted configuration (corresponding to the most depressed stable position of the sheath—see FIG. 5), the transverse face of the applicator element is flush with the edge of the annular end of the tubular element. In contrast, the distance between the angular portions of the heart-shaped track determines the distance the applicator element projects when the sheath reaches its stable position farthest from the bottom of the tubular element (see FIG. 4).

The details of the geometry of the track and the finger are within the ordinary competence of the person skilled in the art, who may in particular choose an inclination of the axis of the heart shape to guarantee that when the sheath is depressed and one of the convex portions has been got past, the finger follows the track to the other retracted position, instead of returning to the retracted position that it has just left. Another way to guarantee that the track is followed correctly is to provide at the location of the convex portions steps in the groove forming the track to prevent retrograde movement.

Figure 6:
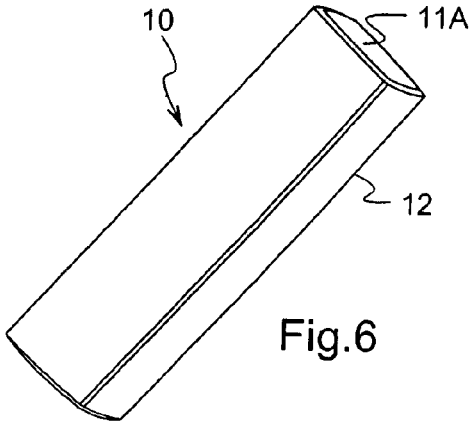
FIG. 6 is a perspective view of the container from FIGS. 1 to 5 in a closed configuration.
Figure 7:
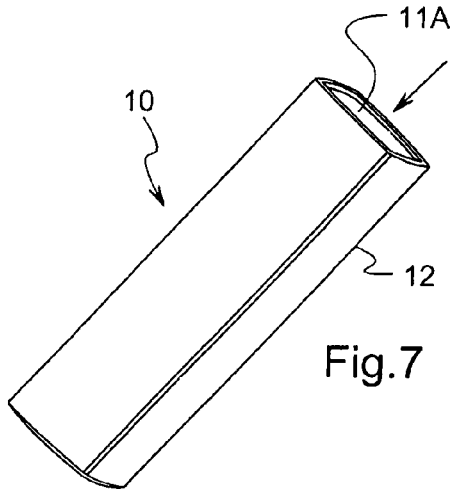
FIG. 7 is a view of the container showing the depression movement for moving the elastically compressible device from the FIG. 5 configuration to that of FIG. 4.
Figure 8:
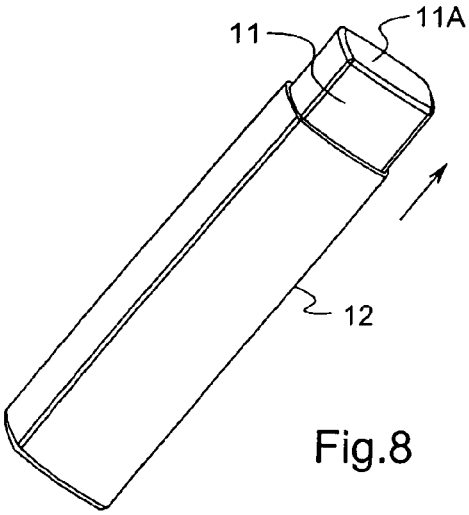
FIG. 8 is a view showing the applicator element projecting from the tubular storage element.

Note that in the closed configuration shown in FIG. 6 (with the axially compressible device in the minimum retracted position), the container has an exterior surface defined, with the exception of the rear transverse face of the applicator element, by the tubular storage element.

Figure 9:
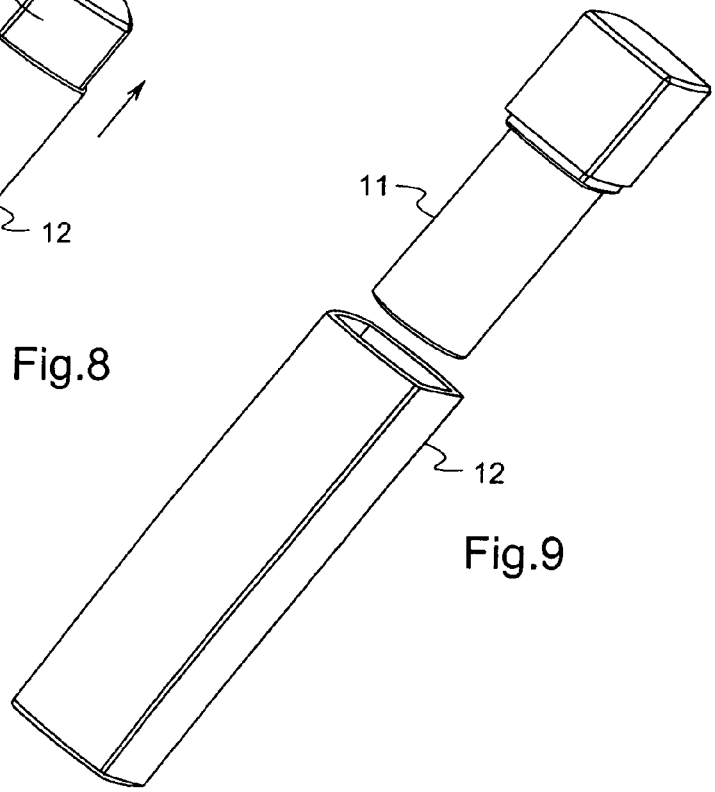
FIG. 9 is a perspective view showing the applicator element removed completely from the tubular element.

A small depression movement (FIG. 7), corresponding to the distance h cited above, is sufficient to move the axially compressible device from its minimum retracted position to its maximum retracted position (FIG. 8) in which the applicator element projects a distance equal to the distance H cited above much greater than the depression distance. It then suffices for the user to grip the projecting portion with two fingers to extract the applicator element from the tubular storage element (FIG. 9).

Figure 10:
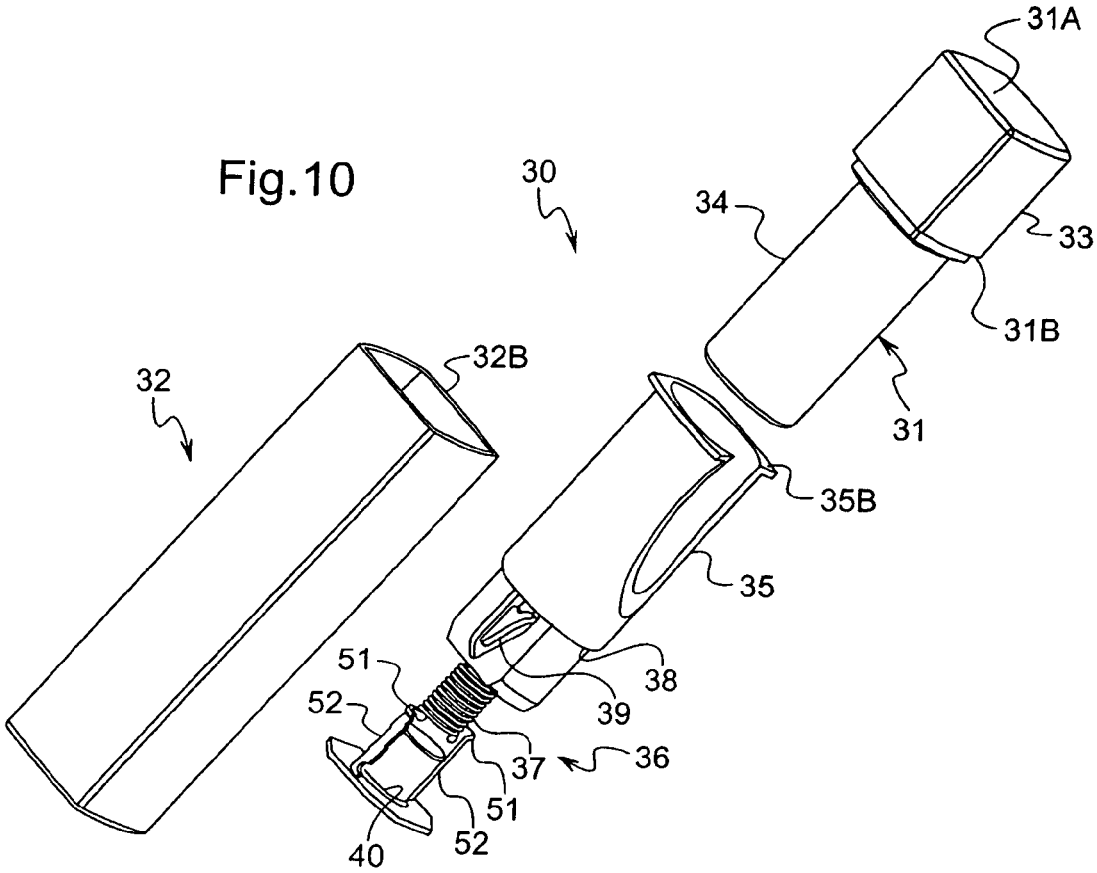
FIG. 10 is a partly cut-away exploded perspective view of a different embodiment of the container from the previous figures.

FIG. 10 shows a container 30 that is very similar to that of FIGS. 1 to 9 except that the axially compressible device 36 includes a finger 51 (there are even two of these fingers, one in front of the other) carried by the bottom of the tubular storage element, while the track 39 is attached to the bottom of the sheath (here there are two tracks on two opposite faces of a fixed block). In FIG. 10, components analogous to those from FIGS. 1 to 9 are assigned a reference number that is deduced from those of the latter figures by adding 20.

In an embodiment that is not shown, each finger and each track are transposed transversely between the sheath and the wall of the tubular storage element.

Figure 11:
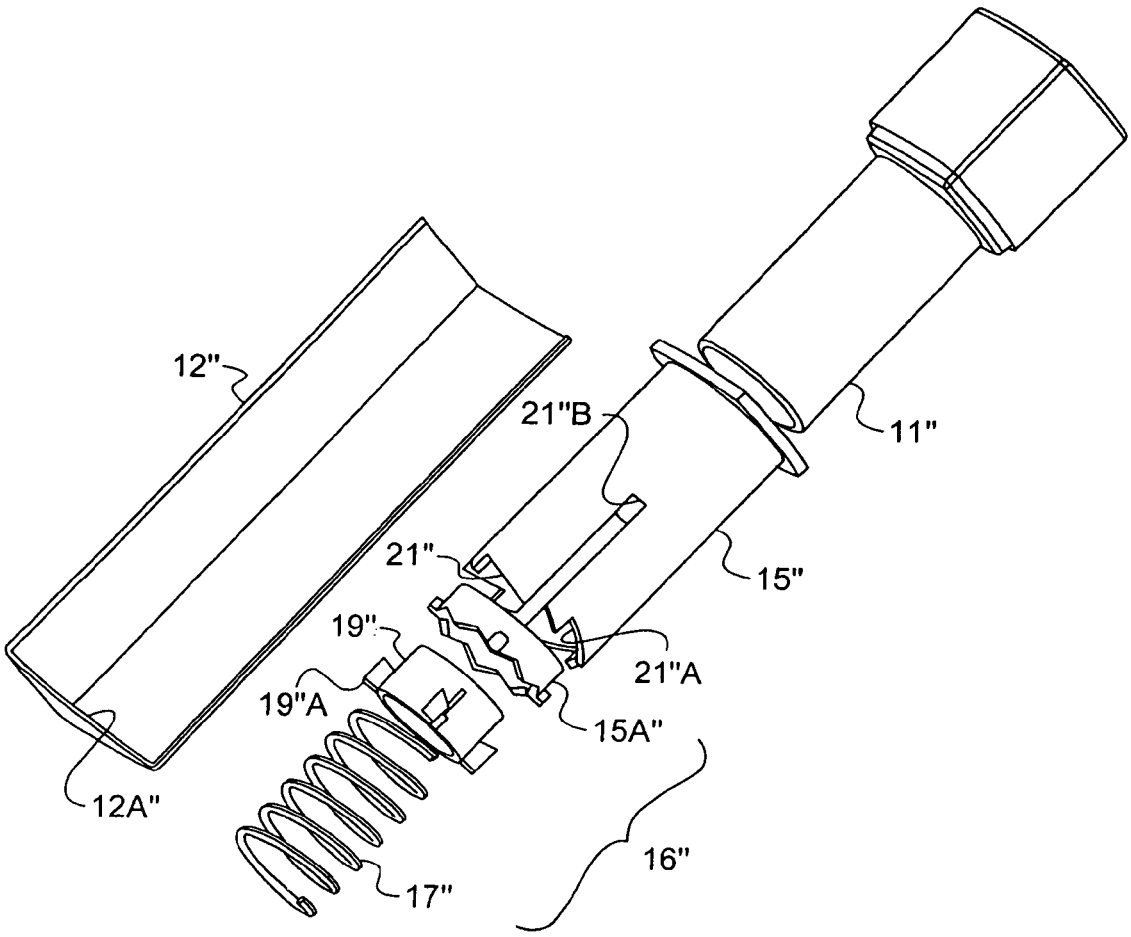
FIG. 11 is an exploded perspective view of another embodiment of a container of the invention.
Figure 12:
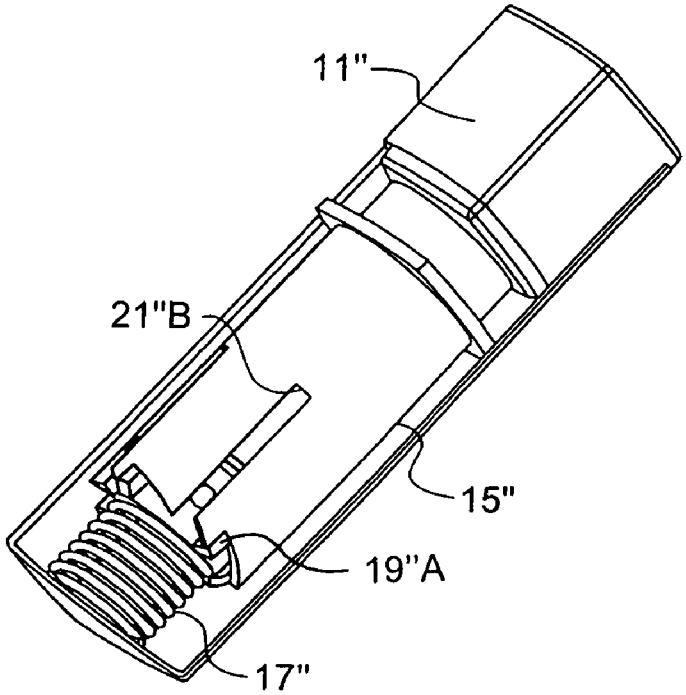
FIG. 12 is a partly cut-away perspective view of the container in a minimum retracted configuration.
Figure 13:
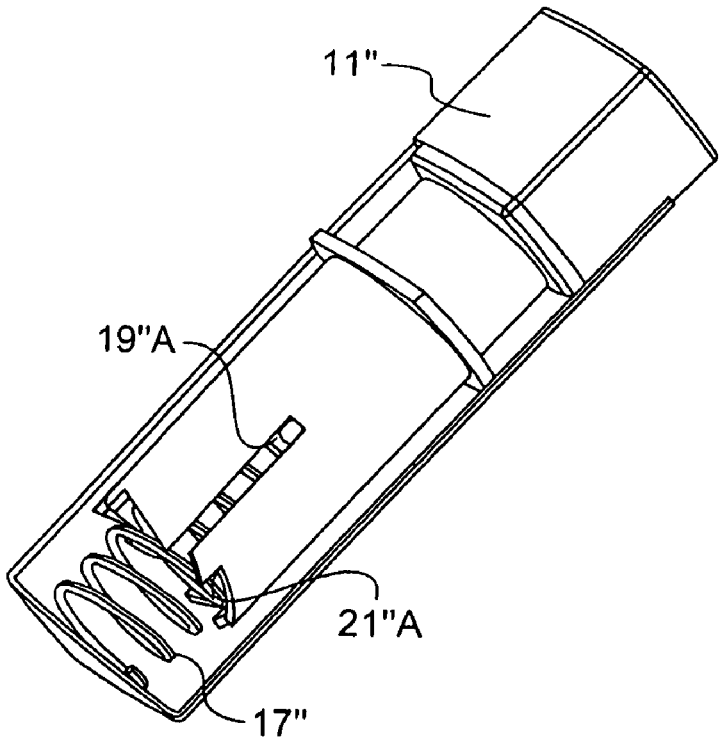
FIG. 13 is a partly cut-away perspective view of the container in a maximum retracted configuration.

FIGS. 11 to 13 show another container with another type of compressible device. Components in these figures that are similar to those in FIGS. 1 to 9 are designated by reference numbers that are deduced from those of the latter figures by adding the "second" symbol (").

Note that the elastically compressible device 16" includes a spring 17" disposed axially between a fixed bearing surface of the tubular storage member, namely the bottom 12A", and a ring 19" that is mobile in rotation and in translation. This ring bears on the bottom of a mobile part 15A" and has radial projections 19"A that are pressed against an annular track 21" of sawtooth shape with troughs of at least two different heights, here shallow troughs 21"A and deep troughs 21"B.

In the FIG. 12 configuration, the applicator element is a friction fit in a female portion 15" which, unlike the sheath 15 from FIGS. 1 to 9, is fixed relative to the tubular storage element. The radial projections 19"A are engaged in the shallow troughs and the applicator element 11", bearing against the mobile part 15A", remains retracted. Depressing the element 11" moves the projections 19"A into the deep troughs, in which projections on the mobile part are also engaged. The latter is pushed out, with the result that the applicator element projects.

Figure 14:
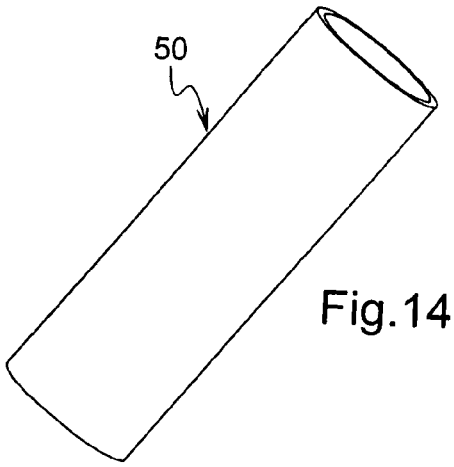
FIG. 14 is a perspective view of another lipstick container having a globally cylindrical section.
Figure 15:
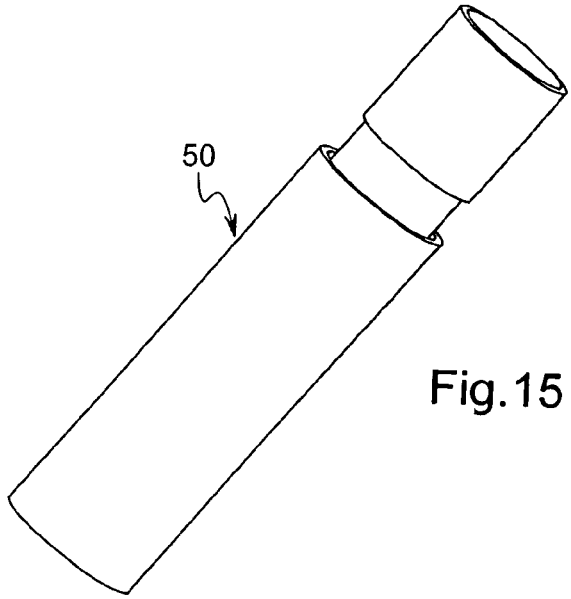
FIG. 15 is view of the container showing the applicator element partly disengaged from the tubular storage element.
Figure 16:
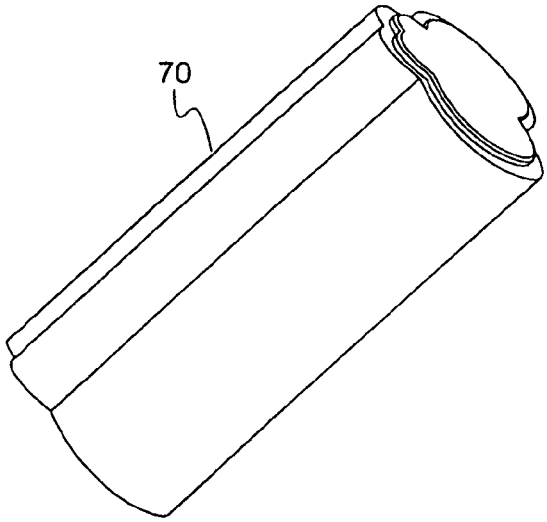
FIG. 16 is a perspective view of another lipstick container having a more complex section.
Figure 17:
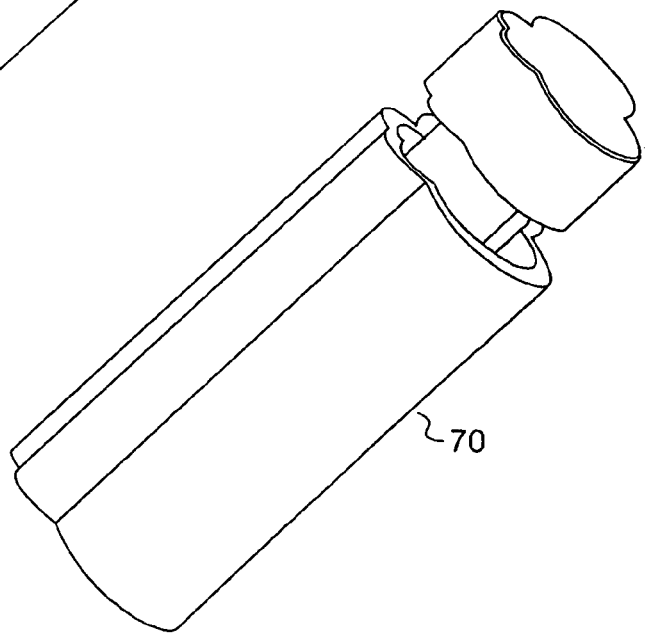
FIG. 17 is another view of the container showing the applicator element partly disengaged from the tubular storage element.

In the above examples, the general section of the container is globally square with rounded corners, but it must be understood that the fact that the invention utilizes only movements in translation authorizes a wide variety of shapes for the section of the container, from a circular section, as represented by the container 50 in FIGS. 14 and 15, to a more complex shape, as represented by the container 70 in FIGS. 16 and 17, with a shape similar to a clover leaf, through intermediate shapes such as elliptical, polygonal, etc. shapes.

Figure 18:
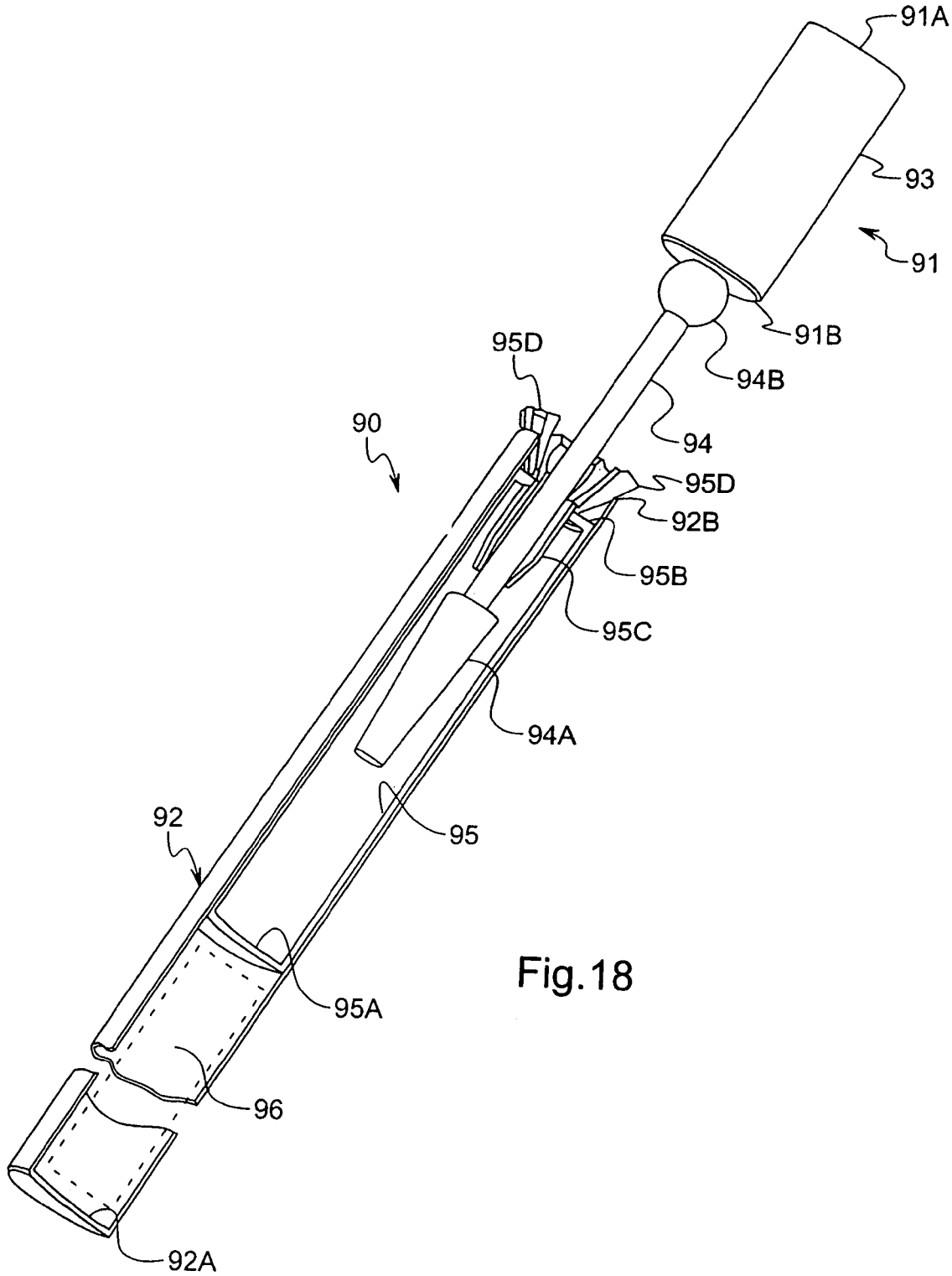
FIG. 18 is a partly cut-away perspective view of another container, suitable for applying mascara, in a configuration in which only a portion of the applicator element is inside the tubular element.
Figure 19:
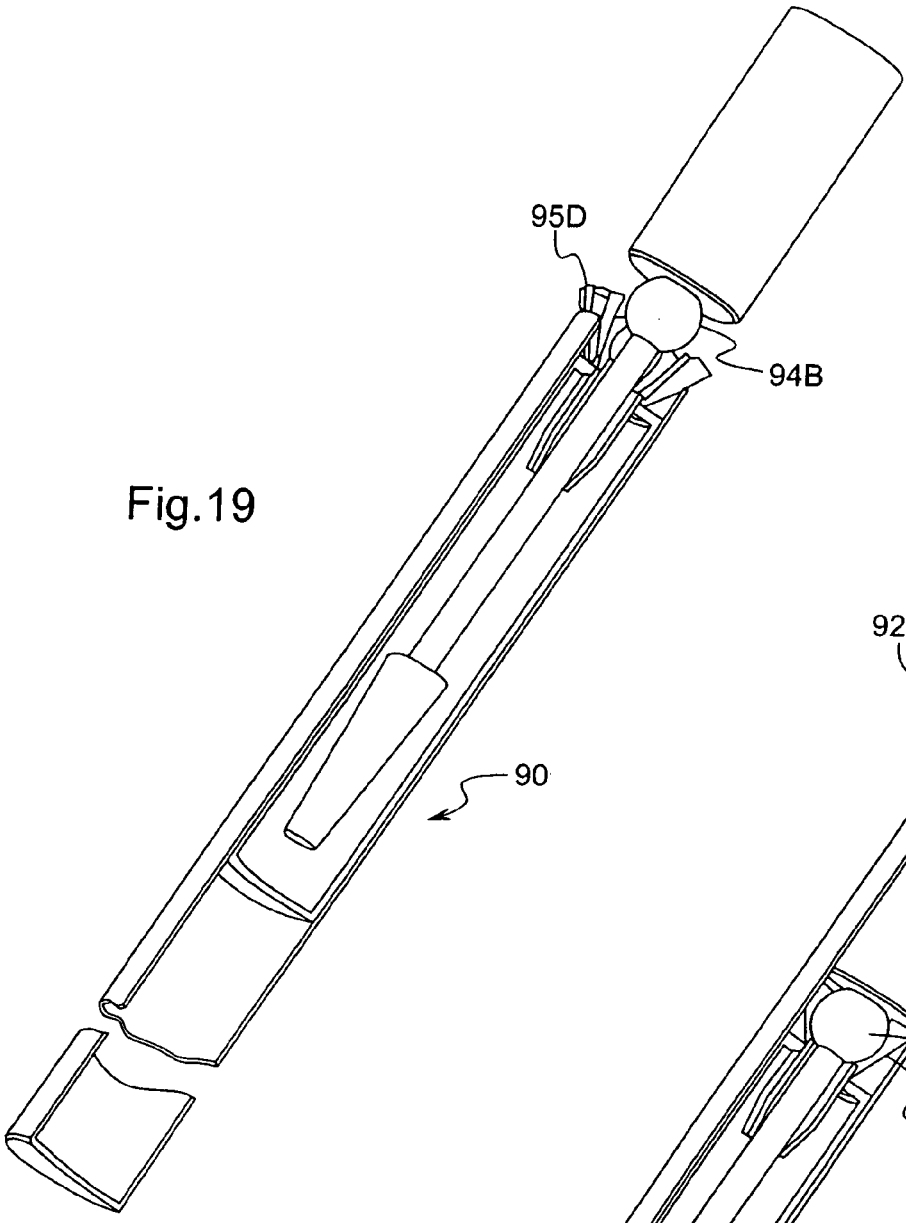
FIG. 19 is another view of the container showing the sheath on the point of moving toward the bottom of the tubular element.
Figure 20:
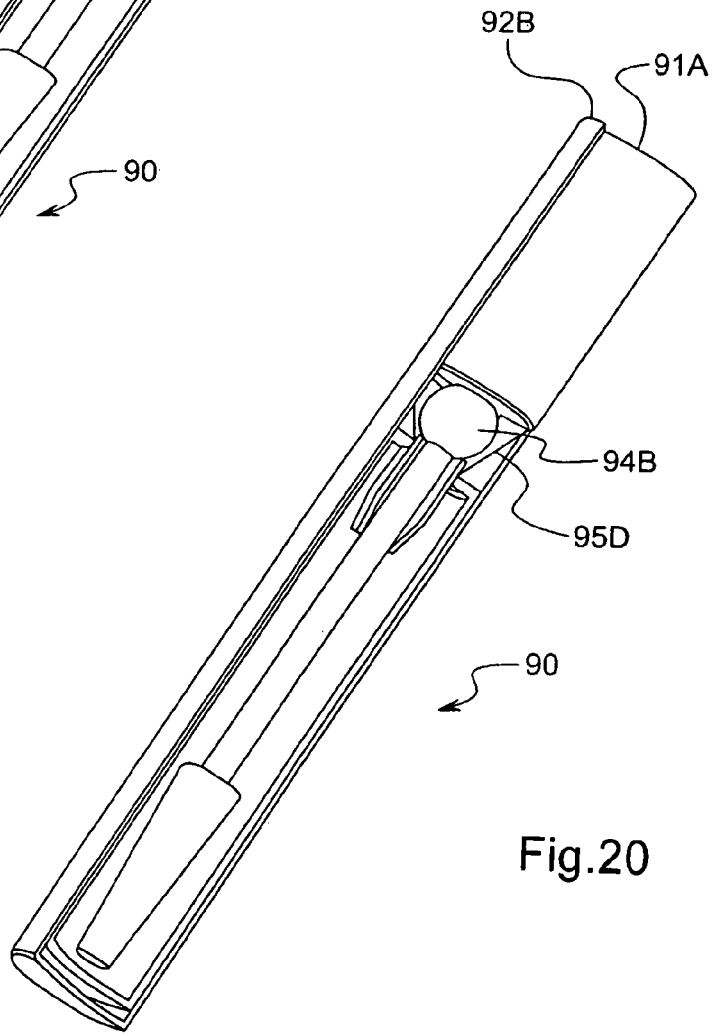
FIG. 20 is another view of the container in a closed configuration.

FIGS. 18 to 20 show another type of container of the invention suitable for a liquid product such as mascara.

This container 90 has various components similar to those of FIGS. 1 to 5 that are designated by reference numbers deduced from those used in the latter figures by adding 80.

As in the containers described above, an axially compressible device 96 is disposed between the bottom 92A of the tubular storage element 92 and the bottom 95A of the sheath 95.

As is well known in the art of mascara applicators, the product is contained in the tubular storage element, here the sheath, and the applicator element includes a stem 94 terminating in an applicator 94A of any appropriate shape, for example a brush, able to enter the sheath in order to be loaded with mascara. The sheath has at the end opposite its bottom a neck 95B fitted with a wiper 95C through which the stem passes and which is adapted to retain any excess mascara picked up by the applicator when dipped in the product.

To ensure a sufficient closure seal to prevent the liquid product leaking, the stem advantageously includes a protuberance 94B, such as a sphere or a cone, and the neck has, on its outside, claws 95D adapted to cooperate with the protuberance and tending normally to be spaced from the axis, for example by virtue of their elasticity. As a result, when the sheath is in a maximum retracted position, the claws extend out of the tubular element and can therefore spread apart, like the petals of a flower, allowing the protuberance to escape. In contrast, when the user pushes the applicator element into the sheath, the protuberance comes up against the base of the claws or the neck and causes depression of the sheath with the claws; when they enter the tubular storage element the claws are forced towards the axis, thereby gripping the protuberance, which prevents it escaping until depression of the axially compressible device allows the sheath to return to its maximum retracted position.

The claws are advantageously shaped to apply a downward axial force to the protuberance when they move towards the axis, to press the protuberance against a seat formed in the neck, here at the base of the claws. This improves the seal.

Clearly, since the applicator element may be extracted without any rotation at all, a great variety of shapes may be adopted for the applicator at the end of the stem. Thus in FIG. 21 the applicator 100 comprises a set of long hairs 101 along which partly extends a point 102 attached to the stem 103. In contrast, in FIG. 22, the applicator 110 is curved and is connected to the stem 111 by an elbow 112; as for the wiper 113, represented in dashed outline, it may also be of any shape, of slot shape or of triangle shape. Clearly the applicator element no longer needs to be straight or to exhibit axial symmetry and the corresponding wiper can also have varied shapes.

The seal between the applicator element and the neck of the sheath may be provided in many different ways, in particular by means of a simple O-ring 120 carried by a frustoconical portion of the stem cooperating with a groove 121 formed in the frustoconical opening of the neck (see FIGS. 23 and 24).

Clearly the invention proposes a system that is discrete by virtue of the retraction of the applicator element into the covering of the tubular storage element and the possibility of obtaining an exterior shape with no break line or joint. This system is also easy to use as it involves applying only a moderate pushing force over a short travel in addition to the movements necessary for extracting and maneuvering the applicator element of prior art containers. Finally, this system offers optimum security since, in the minimum retracted position, the product is protected and unintentional extraction is prevented (there is no accessible projection, edge or shoulder that could catch on an adjacent object). The seal is nevertheless maintained in the case of a liquid or paste product such as mascara or lip-gloss.

Additional functions may be obtained by simple adaptation of the tubular storage element, for example protection against temperature variations, impact, moisture, etc.

Clearly the above teachings apply to a wide variety of products:

lip-gloss, which gives rise to problems similar to mascara,
nail varnish (there is no need for a wiper),
powder products such as foundation, blusher or eye shadow.

The invention claimed is:

1. A container for a solid, liquid, paste or powder cosmetic product, comprising:

a product applicator element having a transverse face, and
a tubular storage element elongate in a longitudinal direction and having a bottom and an annular end;
wherein the applicator element bears against a mobile part that is slidably mounted in the tubular element,
the mobile part connected to the tubular element by an elastically compressible device with two axial retraction configurations relative to an axial depression configuration;
the two axial retraction configurations respectively defining:
a first axial retraction configuration of the applicator element wherein its transverse face is flush with the annular end of the tubular element, and
a second axial retraction configuration in which its transverse face projects relative to the annular end of the tubular element to a distance that is significantly greater than an axial depression travel of the elastically compressible device between the first axial retraction configuration and the axial depression configuration.

2. The container of claim 1, wherein a friction fit of the applicator element is obtained in a female portion of the mobile part.

3. The container of claim 1, wherein the applicator element includes an annular bearing surface adapted to cooperate with a complementary bearing surface of the mobile part.

4. The container of claim 3, wherein the applicator element includes an annular end adapted to bear against a bottom portion of the mobile part.

5. The container of claim 1, wherein a friction fit of the applicator element is obtained in a female portion of the mobile part fastened to the tubular storage member.

6. The container of claim 1, wherein the elastically compressible device comprises:

a spring disposed axially between a first bearing surface and a second bearing surface,
wherein the first bearing surface is attached to at least one heart-shaped closed guide track situated in a plane parallel to the axis of the tubular element, and
the second bearing surface is attached to at least one transverse follower finger adapted to follow the guide track on relative movement between the bearing surfaces.

7. The container of claim 6, wherein the first bearing surface attached to the at least one guide track is attached to the tubular storage element, and the second bearing surface attached to the at least one follower finger is attached to the mobile part.

8. The container of claim 6, wherein the first bearing surface attached to the guide track is attached to the mobile part and the second bearing surface attached to the follower finger is attached to the tubular storage element.

9. The container of claim 6, wherein the at least one guide track and the at least one finger are disposed axially between the mobile part and the bottom of the tubular storage element.

10. The container of claim 6, wherein the first bearing surface is attached to two guide tracks that are symmetrical to each other with respect to an axial plane, and the second bearing surface is attached to two follower fingers that are symmetrical to each other with respect to said axial plane.

11. The container of claim 6, wherein:

the first bearing surface is attached to a single heart-shaped closed guide track, and the second bearing surface is attached to a single transverse follower finger.

12. The container of claim 6, wherein the at least one guide track and the at least one finger are located within the volume of the spring.

13. The container of claim 1, wherein the elastically compressible device includes a spring disposed axially between a fixed bearing surface attached to the tubular storage element and a ring that is mobile in rotation and in translation, wherein the ring bears on the bottom of the mobile part and includes radial projections that press against a sawtooth-shaped annular track having troughs of at least two different heights.

14. The container of claim 1, further comprising a stick of lipstick.

15. The container of claim 1, wherein the product is a liquid or a paste and is contained in the mobile part, the applicator element including a stem terminating in an applicator adapted to be charged with product, the mobile part including a neck adapted to have the stem pass through it, and the stem and the neck including a complementary seal.

16. The container of claim 15, wherein the complementary seal includes a protuberance on the stem and claws on the neck, the claws adapted to be separated from the axis when the mobile part is in a maximum retracted position and to be moved towards the axis when the protuberance pushes the claws and therefore the mobile part towards the bottom of the tubular element.

17. The container of claim 16, wherein the claws apply an axial force to the protuberance when they are moved towards the axis so as to press the protuberance against a seat formed in the neck.

18. The container of claim 15, wherein the liquid product is nail varnish.

19. The container of claim 15, further comprising a wiper adapted to wipe the applicator as it leaves the mobile part.

20. The container of claim 19, wherein the applicator and the wiper have non-circular cross sections.

21. The container of claim 19, wherein the liquid or paste product is mascara.

22. The container of claim 19, wherein the product is lip-gloss.

23. The container of claim 1, wherein the product is foundation.

24. The container of claim 1, wherein the product is blusher or eye shadow.

* * * * *